United States Patent [19]

McWilliams

[11] 4,393,299

[45] Jul. 12, 1983

[54] ELECTRIC RADIANT HEATER UNIT FOR A GLASS CERAMIC TOP COOKER

[75] Inventor: Joseph A. McWilliams, Droitwich, England

[73] Assignee: Micropore International Limited, Droitwich, England

[21] Appl. No.: 321,634

[22] Filed: Nov. 16, 1981

[30] Foreign Application Priority Data

Nov. 17, 1980 [GB] United Kingdom ..... 8036864

[51] Int. Cl.[3] ..... H05B 3/68

[52] U.S. Cl. ..... 219/446; 219/449; 219/458; 219/460; 219/464; 219/466; 219/468; 338/218; 338/299; 338/305

[58] Field of Search ..... 219/446, 449, 558, 559, 219/560, 464, 466, 467, 468, 512, 523, 553; 338/217, 218, 299, 303, 304, 305

[56] References Cited

U.S. PATENT DOCUMENTS

| | | | |
|---|---|---|---|
| 652,638 | 6/1900 | Potter | 338/218 X |
| 1,110,532 | 9/1914 | Byce | 338/218 X |
| 2,155,425 | 4/1939 | La Mere | 219/446 |
| 2,371,696 | 3/1945 | Lewitt | 338/218 X |
| 2,419,083 | 4/1947 | Myers | 219/446 |
| 2,450,399 | 9/1948 | Sheidler | 219/446 X |
| 2,680,183 | 6/1954 | Gomersall | 338/296 X |
| 3,219,800 | 11/1965 | Alexander | 219/446 |
| 3,819,903 | 6/1974 | Frick | 219/464 |
| 4,243,874 | 1/1981 | Fischer | 219/464 |
| 4,327,280 | 4/1982 | McWilliams | 219/464 |
| 4,347,432 | 8/1982 | Gössler | 219/449 |
| 4,350,875 | 9/1982 | McWilliams | 219/449 |

FOREIGN PATENT DOCUMENTS

| | | | |
|---|---|---|---|
| 653432 | 11/1937 | Fed. Rep. of Germany | 219/464 |
| 2219890 | 4/1972 | Fed. Rep. of Germany | 219/464 |
| 258463 | 9/1926 | United Kingdom | 219/464 |
| 502559 | 3/1939 | United Kingdom . | |
| 624259 | 6/1949 | United Kingdom . | |
| 2061679 | 5/1981 | United Kingdom | 219/464 |

*Primary Examiner*—Volodymyr Y. Mayewsky
*Attorney, Agent, or Firm*—Browdy and Neimark

[57] ABSTRACT

An electric radiant heater unit for a glass ceramic top cooker includes an inner circular heating coil and an outer annular coil surrounding the circular coil. The two coils are separated by a dividing wall of thermal insulating material and the annular coil is surrounded by a peripheral wall of thermal insulating material. The inner coil may be energized alone or both coils may be energized together. The electrical resistance of the inner and outer coils is such that the watts density within the peripheral wall when both coils are energized is greater than the watts density within the dividing wall when only the inner coil is energized.

6 Claims, 3 Drawing Figures

ELECTRIC RADIANT HEATER UNIT FOR A GLASS CERAMIC TOP COOKER

BACKGROUND OF THE INVENTION

The present invention relates to electric radiant heater units of the kind used in glass ceramic top cookers. More particularly, the invention relates to such heater units which employ two or more heater elements in the same unit.

DESCRIPTION OF PRIOR ART

Electric cookers heat utensils placed on the heater units by heat transmitted thereto by convection, conduction and radiation. Of these, conduction and radiation are dominant, radiant heat from the unit passing to the utensil and heat being conducted to the utensil by direct contact with the heater unit. The amount of heat conducted to the utensil is dependent of course on the degree of contact between the utensil and the heater unit. In the case of a glass ceramic top cooker, the contact is with the smooth glass ceramic top which is heated by the heater unit.

A glass ceramic top cooker is one in which a smooth top of glass ceramic overlies one or more generally circular electric heater elements supported on a layer of thermal and electrical insulating material such that the elements are spaced from the underside of the glass ceramic top of the cooker. In use, a utensil placed on the glass ceramic top above a heater element is heated by the transmission of heat from the element to and through the glass ceramic top by air convection, conduction and infra-red radiation. Such elements are referred to as radiant heaters. The insulating material substantially prevents heat being transmitted away from the heater element except towards the glass ceramic top and, because the preferred materials for the top are essentially non-conductive, only areas of the top which are directly exposed to the heater element will be heated. In order to prevent heat being transmitted to parts of the top not covered by a utensil placed thereon, a peripheral wall of insulating material is also normally provided around the heating coil.

Electric cookers have always operated most efficiently with utensils having bases which conform to the surface of the heater units to obtain maximum contact with, and thus maximum heat conduction to, the utensil. Utensils with flat bases were designed particularly for electric cookers, and thicker bases were used to assist in preserving their planarity. Currently, utensils are formed with a slight inwardly extending dome in the base which enhances the stability of the utensil on the cooker and ensures that an outwardly extending dome cannot exist. An outwardly extending dome makes the utensil unstable and leads to uneven heat transfer to the utensil and is to be avoided wherever possible. Any distortion of the utensil over long use will cause the base to deform outwardly and thus an orginally flat base will tend to develop an outwardly extending dome. Typically a circular utensil is formed with an inwardly extending dome in its base, the height of the dome being no more than 0.5% of its diameter.

OBJECT OF THE INVENTION

It is an object of the present invention to overcome the problems of heat transfer to a domed utensil and thereby to maximise the heat conduction from a glass ceramic cooking surface to a typical utensil placed thereon.

SUMMARY OF THE INVENTION

According to the present invention there is provided an electric radiant heater unit for a glass ceramic top cooker, the heater unit comprising:

at least two heater elements arranged such that one heater element extends substantially entirely around the periphery of the other heater element or elements, said other element or elements being energisable independently of said one element;

a dividing wall of thermal insulating material arranged between said one element and said other element or elements; and a peripheral wall of thermal insulating material surrounding said one element, wherein the electrical resistance of said one element and of said other element or elements is such that, in use, the electrical power fed to said one element and to said other element or elements per unit surface area of the heater unit enclosed by the peripheral wall is greater than the electrical power fed to said other element or elements per unit surface area of that part of the heater unit enclosed by the dividing wall.

In one embodiment of the present invention, the heater unit comprises two heater elements, said other element being substantially circular and said one element being annular and extending substantially around said other element. Preferably, in use, the electrical power fed to said other element is 800 watts, the area enclosed by the dividing wall having a diameter of 137 mm, and the electrical power fed to said one element is 1000 watts, the area enclosed by the peripheral wall having a diameter of 195 mm.

The arrangement of said other element or elements may be such that, in use, the heat emitted in the peripheral region of the area enclosed by the dividing wall is greater per unit surface area than the heat emitted in the central region of said area. Where said other element or elements are wound in a spiral or in substantially concentric circular areas, the spacing between adjacent areas of the heater element or elements may be reduced towards the periphery. Alternatively, where said other element or elements are in the form of a helically wound coil, the pitch of the turns, that is the axial spacing between adjacent winds of the coil, of the heater element may be reduced towards the periphery.

For a better understanding of the present invention and to show more clearly how it may be carried into effect reference will now be made, by way of example, to the accompanying drawings in which:

DESCRIPTION OF PREFERRED EMBODIMENTS

Figure 1:
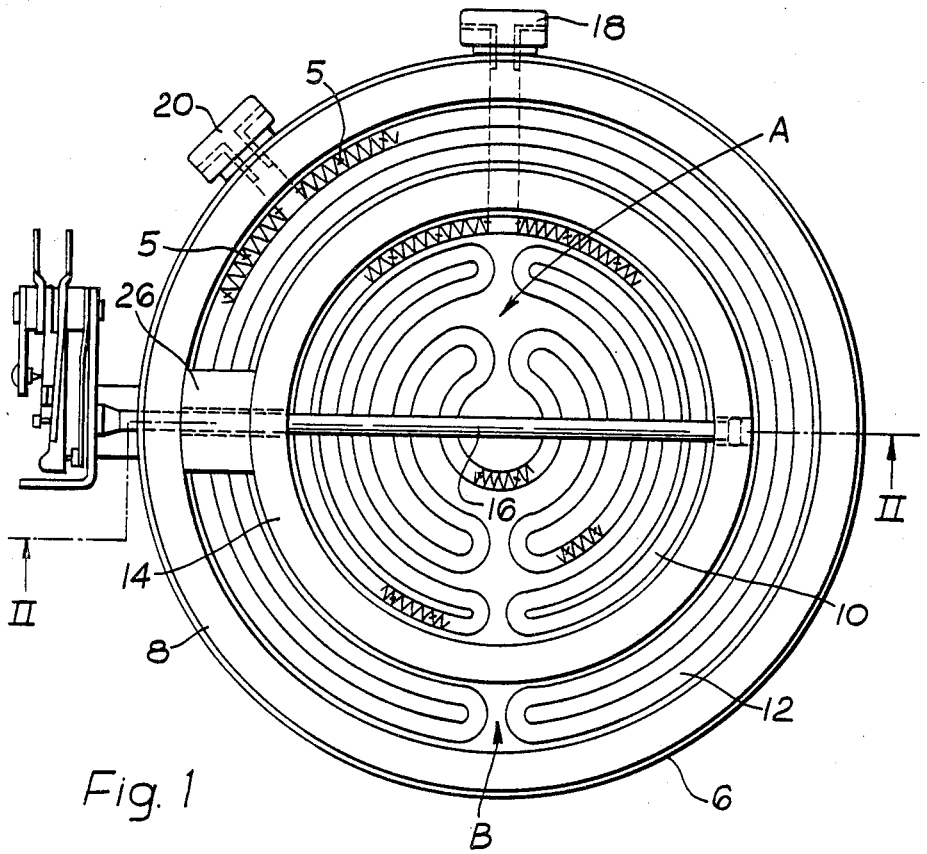
FIG. 1 shows a plan view of one embodiment of a heater unit according to the present invention.
Figure 2:
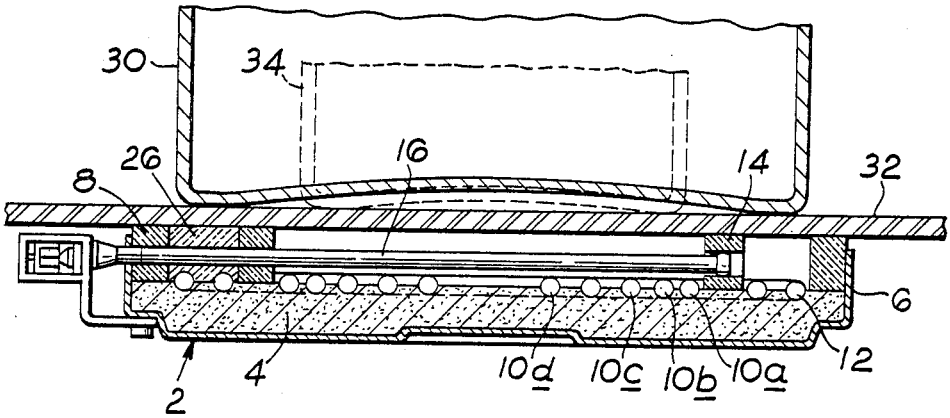
FIG. 2 is a sectional view taken along line II—II of FIG. 1.

FIGS. 1 and 2 show a heater unit which comprises a metal dish 2 containing a base layer 4 of electrical and thermal insulating material. The metal dish 2 is formed with a side 6 against which is located a peripheral wall 8 of thermal insulating material. Set in grooves formed in the base layer 4 are two substantially concentric electric heater coils 10 and 12 which are separated from each other by a circular dividing wall 14 of thermal insulating material. The dividing wall 14 separates the heating area defined by the peripheral wall 8 into a central zone A and an annular zone B. Extending over the coil 10 is a thermal cut-out device 16 which is operable to switch off both coils in the event of overheating.

Each coil is controllable independently through terminal connectors 18 and 20 enabling a relatively small circular pan or other utensil to be heated solely by the coil 10 and a larger similar utensil to be heated by both coils 10 and 12. Each coil is unprotected and is secured to the base layer 4 by means of staples 5. Each coil is preferably made from an iron-chromium-aluminium resistance heating wire.

The principle of using two separately and independently operable heating coils in a radiant heater of the kind described herein is disclosed and claimed in co-pending U.S. patent application Ser. No. 118,951, now issued as U.S. Pat. No. 4,327,280, to which reference is directed. The circular heating units illustrated herein provide a heater heaving a circular heating zone A and an annular heating zone B, but the same principle may be applied to other shapes of heater in which an inner coil is substantially surrounded by an outer coil, e.g. oval, square or rectangular heaters.

As shown in FIG. 1, a block of 26 of insulation material is shaped to fit between the walls 8 and 14 and to receive the cut-out device 16. The windings of the coil 12 are straightened where they pass beneath the block 26. The height of the block 26 is such as to reach substantially the same level as the peripheral wall 8 and the dividing wall 14 so that the walls and the block may all bear against the underside of the glass ceramic top when the heater unit is installed in a cooker. The material of the block may be, for example, a ceramic fibre or a microporous insulating material. The material of the base layer 4 is preferably a microporous insulating material, whereas the material of the walls 8 and 14 is preferably a ceramic fibre.

FIG. 2 shows the lower portion of a pan 30 resting on the top 32 of a glass ceramic top cooker against the underside of which the heater unit is mounted. The base of the pan is domed (note: for clarity the height of the dome is exaggerated in FIG. 2) and is supported in the region of its outer periphery over the coil 12. Maximum contact, therefore, between the pan and the glass ceramic top is in the heated zone B. According to the present invention, the watts density in the zone B is increased relative to zone A so that maximum transfer of heat takes place in zone B. This is achieved by increasing the wattage in the coil 12 relative to the wattage of coil 10. A typical total wattage for a 215 mm diameter unit is 1800 watts. The construction of the unit is such that there is an inner heating zone A having a diameter of 137 mm and an outer annular heating zone B which extends to 195 mm diameter. The two zones are separated by a dividing wall which is effectively 10 mm thick. Conventionally, the two zones are rated equally, i.e. at 900 watts each, thus giving the inner zone a watts density of 0.061 watts/mm$^2$ and the overall heated area a watts density of 0.060 watts/mm$^2$. However, if the outer zone is rated at 1000 watts and the inner zone at 800 watts, giving a watts density of 0.054 watts/mm$^2$ for the inner zone and the same watts density of 0.060 watts/mm$^2$ for the overall heated area, we have found that the boiling time for 1 liter of water in a pan 30 resting on the glass ceramic top of the cooker in the manner illustrated can be reduced by 20 to 25%. This significant reduction in boiling time is surprising because one would expect the heat loss in the peripheral zone B to increase and thus the boiling time would not be expected to decrease noticeably. However, it has been found that this heat loss is more than compensated by the better conductive heat transfer to the pan in the peripheral zone.

For a smaller pan such as a pan 34 which is shown in dotted lines in FIG. 2, only the coil 10 would normally be used. Again, though, it may be desirable to increase the watts density in the peripheral region of the effective heater zone A. This is achieved by reducing the radial spacing between adjacent arcs of the coil 10 towards the periphery. As shown, the spacing between the arcs 10*a* and 10*b* is closer than the spacing between the arcs 10*b* and 10*c*, the spacing increasing progressively towards the centre most arc 10*d*.

Figure 3:
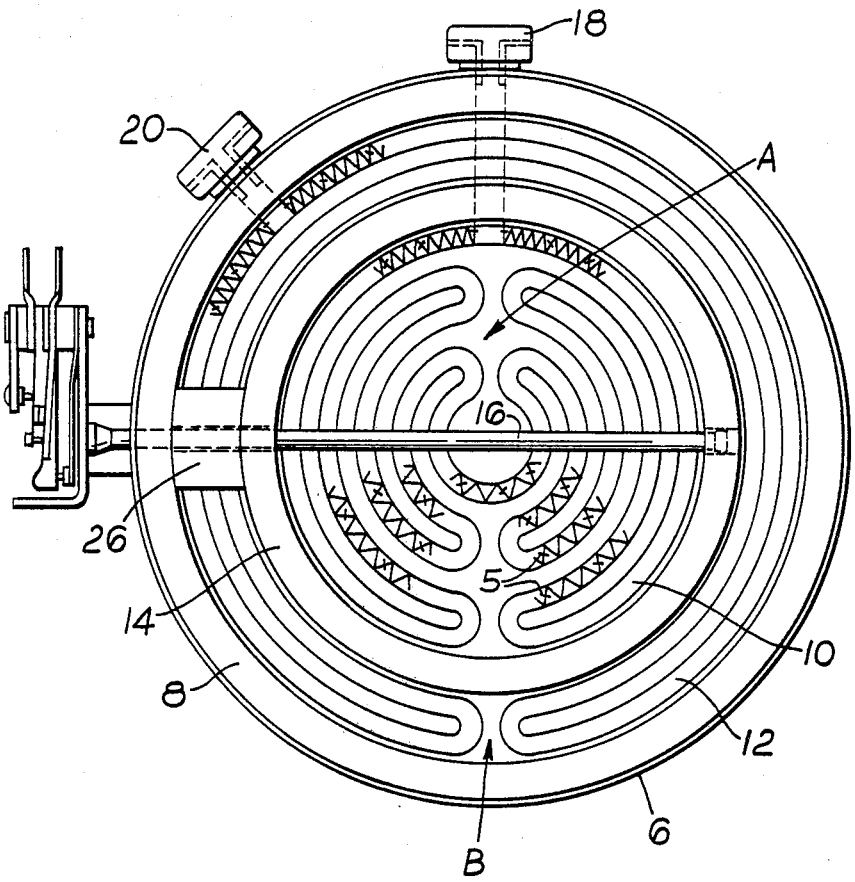
FIG. 3 is a plan view of another embodiment of a heater unit according to the present invention.

Alternatively, as shown diagrammatically in FIG. 3, the radial spacing between adjacent arcs may be maintained constant, but the pitch of the inner coil 10 (that is the spacing between adjacent winds of the coil) may decrease as the radial distance from the centre of the heater increases.

While the invention has been described in detail above, it is to be understood that this detailed description is by way of example only, and the protection granted is to be limited only within the spirit of the invention and the scope of the following claims.

I claim:

1. An electric radiant heater unit for a glass ceramic top cooker, the heater unit comprising:

a base layer of electrical and thermal insulating material;

at least first and second bare heater elements positioned on said base layer and arranged such that said second heater element extends substantially entirely around the periphery of said first heater element;

means to connect said heater elements to a power source;

means for energising said first heater element independently of said second heater element;

a dividing wall of thermal insulating material positioned on said base layer and arranged between said first and second heater elements for keeping heat within said dividing wall; and a peripheral wall of thermal insulating material positioned on said base layer and surrounding said second heater element for keeping heat within said peripheral wall, wherein said second heater element has an electrical resistance and said first heater element has an electrical resistance such that, in use of the heater unit, the electrical power fed to said second heater element and to said first heater element per unit surface area of the heater unit enclosed by the peripheral wall is greater than the electrical power fed to said first heater element per unit surface area of that part of the heater unit enclosed by the dividing wall.

2. A heater unit according to claim 1, said first element being substantially circular and said second heater element being annular and extending substantially entirely around said first element.

3. A heater unit according to claim 1, wherein said first heater element is rated at about 800 watts and the area enclosed by the dividing wall has a diameter of about 137 mm, and said second heater element is rated at about 1000 watts and the area enclosed by the peripheral wall has a diameter of about 195 mm.

4. A heater unit according to claim 1, wherein the arrangement of said first heater element is such that, in use, the heat emitted in the peripheral region of the area enclosed by the dividing wall is greater per unit surface area than the heat emitted in the central region of said area.

5. A heater unit according to claim 4, wherein the arrangement of said first heater element is such that the spacing between adjacent arcs of the heater element is reduced towards the periphery of said area.

6. A heater unit according to claim 4, wherein the arrangement of said first heater element is such that the pitch of the turns of the heater element is reduced towards the periphery of said area.

* * * * *